United States Patent [19]

Ichikawa et al.

[11] Patent Number: 4,899,386

[45] Date of Patent: Feb. 6, 1990

[54] DEVICE FOR DECIDING POLE-ZERO PARAMETERS APPROXIMATING SPECTRUM OF AN INPUT SIGNAL

[75] Inventors: Masako Ichikawa; Yukio Mitome, both of Tokyo, Japan

[73] Assignee: NEC Corporation, Tokyo, Japan

[21] Appl. No.: 167,275

[22] Filed: Mar. 11, 1988

[30] Foreign Application Priority Data

Mar. 11, 1987 [JP] Japan ..... 62-57330
Mar. 16, 1987 [JP] Japan ..... 62-61737
Mar. 16, 1987 [JP] Japan ..... 62-61738

[51] Int. Cl.[4] ..... G10L 5/00

[52] U.S. Cl. ..... 381/43; 381/29; 381/51

[58] Field of Search ..... 381/29–53

[56] References Cited

U.S. PATENT DOCUMENTS 4,520,499 5/1985 Montlick et al. ..... 381/43
4,586,193 4/1986 Seiler et al. ..... 381/51

*Primary Examiner*—Emanuel S. Kemeny
*Attorney, Agent, or Firm*—Sughrue, Mion, Zinn, Macpeak & Seas

[57] ABSTRACT

For use in deciding optimum pole and zero parameters for an input signal with reference to an input cepstrum of the signal, candidate pole and zero parameters are stored in advance in a table. Supplied with an impulse and controlled by a candidate set pair of a pole parameter set and a zero parameter set selected from the candidate pole and zero parameters of the table, first and second filters produce first and second outputs defined by terms of up to a certain order. Responsive to the first and second outputs and to factors of multiplication which are given by inverse numbers of time intervals related to the respective terms, an analysis filter produces a converted signal which is equivalent to a model output cepstrum of a model output signal produced by a pole-zero model defined by the candidate set pair. A cepstrum subtracter calculates a cepstrum difference between the input cepstrum and the converted signal. In connection with a few candidate set pairs, cepstrum differences and then squares of the respective cepstrum differences are calculated to decide the optimum pole and zero parameters by a focussing technique. Alternatively, a square of the cepstrum difference is used together with partial derivatives of the square to decide the optimum pole and zero parameters.

6 Claims, 5 Drawing Sheets

DEVICE FOR DECIDING POLE-ZERO PARAMETERS APPROXIMATING SPECTRUM OF AN INPUT SIGNAL

BACKGROUND OF THE INVENTION

This invention relates to a pole-zero analyzer for use in deciding pole and zero parameters used collectively in approximating a spectrum of an input signal which is typically a speech signal.

It is important in speech analysis and synthesis to extract parameters from a speech signal. It becomes necessary depending on the circumstances to decide such parameters for a more general signal. Poles and zeros are often used as the parameters in connection with such an input signal. This is because the pole and zero parameters are clear in physical meanings and are convenient for application to synthesis of the signal and other applications.

For use in deciding the pole parameters, a method is described in Chapter 7 of a book written by J. D. Markel and A. H. Gray, Jr., under the title of "Linear Prediction of Speech" and published 1967 by Springer Verlag. According to Markel et al, the pole parameters are extracted from a speech signal by solving by approximation, such as the Newton-Raphson approximation, a higher-order algebraic equation in which coefficients are given by linear predictive encoding (LPC) of the speech signal.

This method gives an excellent result for formants of human voice. A great amount of calculation is, however, necessary on solving the algebraic equation by approximation. Furthermore, it is difficult to stably decide the frequency and the bandwidth of each pole parameter. In addition, no zero parameters are obtained. The pole parameters must therefore be calculated to a high order depending on the shape of spectrum of the input signal. This results in an increased amount of calculation.

Another method is for use also in deciding the pole parameters for a speech signal and is disclosed in a paper released Oct. 26, 1981, by Katsunobu Fushikida under the title of "A Focusing Formant Extraction Method Using Autocorreltaion Domain Inverse Filtering" in Japanese together with an abstract in English as "Nippon Onsei Gakukai Kenkyûkai Siryô Bangô S81-41" (Paper No. S81-41 of a Study Group of the Acoustical Society of Japan). According to the Fushikida paper, a pole parameter table is preliminarily formed to provide candiate pole parameters. Focussing is carried out towards each optimum pole parameter in a predetermined number of stages. In each stage, a preselected number of candidate pole parameters are selected as selected pole parameters. One of the selected pole parameters is used at first as a rough approximation of the optimum pole parameter. In the last stage, a close approximation gives the optimum pole parameter.

The method of the Fushikida paper is excellent in stably deciding each optimum pole parameter. A great deal of calculation is, however, necessary in carrying out the focussing. Moreover, only the pole parameters are obtained.

A method of deciding the pole parameters as well as the zero parameters is revealed in an article contributed by Clifford T. Mullis and Richard A. Roberts to IEEE Transactions on Acoustics, Speech, and Signal Processing, Volume ASSP-24, No. 3 (Jun. 1976), pages 226 through 238, under the title of "The Use of Second-Order Information in the Approximation of Discrete-Time Linear Systems." According to the Mullis et al article, spectrum envelope of a speech signal is approximated by a pole-zero model or system which has a transfer function represented by:

$$Q(\exp[j\omega])/A(\exp[j\omega]) = \left(\sum_{k=0}^{m-1} q_k \cdot \exp[-j\omega k]\right) / \left(\sum_{i=0}^{n-1} a_i \cdot \exp[-j\omega i]\right). \quad (1)$$

where $a_0$ is equal to unity. The pole-zero model comprises up to an (n−1)-th order pole circuits and up to an (m−1)-th order zero circuits to produce a model output signal.

The method of the Mullis et al article is based on the fact that the model output signal best approximates the input signal when coefficients $a_i$ of the denominator polynomial and coefficients $q_k$ of the numerator polynomial have best values which minimizes the following quadratic form:

$$[1/(2\pi)] \int_{-\pi}^{\pi} |H(\exp[j\omega]) \cdot A(\exp[j\omega]) - Q(\exp[j\omega])|^2 d\omega, \quad (2)$$

where H(exp[jω]) represents the spectrum envelope of the speech signal. In Equation (2), the denominator of the transfer function is combined with the spectrum envelope in a first term of the integrand. The numerator of the transfer function is used as a second term of the integrand.

When viewed in a time domain, minimization of Equation (2) is equivalent to solving a set of simultaneous equations including coefficients $a_i$ of the denominator polynomial and coefficients $q_k$ of the numerator polynomial as unknowns for which coefficients are given by an autocorrelation sequence of the speech signal and by an impulse response related to the speech signal. The autocorrelation sequence and the impulse response are readily calculated by application of the method described in Chapter 7 of the above-referenced book of Markel et al. It is unnecessary in this event to solve a higher-order algebraic equation.

According to Mullis et al, the spectrum of the input signal is excellently approximated by the parameters of up to a relatively low order because the zero parameters are obtained as well. It is, however, necessary on deciding the pole and the zero parameters from the best values of the coefficients $a_i$ and $q_k$ to solve an n-th order algebraic equation and an m-th order algebraic equation. For a speech signal, the number of zero parameters is small. No problem therefore arises on solving the m-th order algebraic equation. In contrast, the pole parameters are necessary up to about fifteenth order. A considerable amount of calculation is necessary on solving the n-th order algebraic equation.

On the other hand, it is known to calculate an input cepstrum related to each time window, such as the Hamming window known in the art, of an input signal. The cepstrum reperesnts a spectrum envelope of the input signal by input cepstrum components or data of up to an order of a few scores.

SUMMARY OF THE INVENTION

It is therefore an object of the present invention to provide a pole-zero analyzer capable of deciding pole and zero parameters with a small amount of calculation.

It is another object of this invention to provide a pole-zero analyzer of the type described, which makes use of an input cepstrum on deciding the pole and zero parameters.

It is still another object of this invention to provide a pole-zero analyzer of the type described, which need not solve a higher-order algebraic equation and can consequently stably decide the pole and zero parameters.

Other objects of this invention will become clear as the description proceeds.

It is possible on describing the gist of this invention to understand that a pole-zero analyzer is supplied with an input cepstrum related to each time window of an input signal and is for deciding optimum pole parameters, n in number, and optimum zero parameters, m in number, where each of n and m represents a predetermined integer.

According to this invention, the above-understood analyzer comprises: (A) pole-zero memory means for memorizing a plurality of candidate pole and zero parameters in memorized set pairs, each memorized set pair consisting of a pole parameter set of n candidate pole parameters and a zero parameter set of m candidate zero parameters, the pole-zero memory means producing one of the memorized set pairs at a time as a candidate set pair; (B) first signal producing means responsive to the pole pamameter set of the candidate set pair for producing a first output signal; (C) second signal producing means responsive to the zero parameter set of the candidate set pair for producing a second output signal; (D) converting means for converting the first and the second output signals to a converted signal which is equivalent to a model output cepstrum of a model output signal produced by a pole-zero model defined by the canditate set pair; (E) a subtracter for calculating a difference between the input cepstrum and the converted signal to produce a difference signal representative of the difference; and (F) selecting means responsive to the difference signal for selecting one of the memorized set pairs as a selected set pair consisting of the optimum pole parameters and the optimum zero parameters.

In connection with the above-described pole-zero analyzer according to this invention, attention will be directed to a pole-zero model which comprises n model pole circuits and m model zero circuits. When the optimum pole parameters are used in the respective model pole circuits and furthermore when the optimum zero parameters are used in the respective model zero circuits, the pole-zero model produces a model output signal which best approximates the input signal.

In the manner described with reference to the Mullis et al article cited heretobefore, the pole-zero model has a transfer function represented by Equation (1). In contrast to minimization of Equation (2) according to the Mullis et al article, the optimum pole and zero parameters are decided in accordance with principles of this invention so as to minimize a square error R defined in compliance with:

$$R = [1/(2\pi)] \int_{-\pi}^{\pi} |\log H(\exp[j\omega]) - \log[Q(\exp[j\omega])/A(\exp[j\omega])]|^2 d\omega.$$

Minimization of the square error R is equivalent in a time domain to minimization of a square error between an input cepstrum extracted from the input signal and a model output cepstrum of a model output signal. The input cepstrum is readily calculated by using a fast Fourier transform (FFT) calculator.

On the other hand, model output cepstra of a certain number of pole-zero models are necessary on minimizing the square sum. Inasmuch as the pole and zero parameters must be decided by minimization, pole and zero parameters must be estimated at first as estimated pole and zero parameters and must be used in producing various synthesized signals. The fast Fourier transform calculator is thereafter used in calculating the model output cepstra. A considerable amount of calculation becomes necessary. It is, however, possible in accordance with this invention to astonishingly reduce the amount of calculation by using the converted signal described above.

DESCRIPTION OF THE PREFERRED EMBODIMENTS

It may be mentioned at the outset in connection with the present invention that a pole-zero analyzer is supplied with an analyzer input signal and is for use in deciding, with reference to an input cepstrum related to each time window of the input signal, pole and zero parameters of a pole-zero model or system which comprises a plurality of model pole circuits, n in number, and a less number of model zero circuits, m in number, where each of the numbers n and m represents a predetermined integer. When decided by the pole-zero analyzer, the pole and the zero parameters are herein called optimum pole parameters and optimum zero parameters. When the optimum pole parameters are used in the respective model pole circuits and furthermore when the optimum zero parameters are used in the respective model zero circuits, the pole-zero model produces a model output signal which best approximates the analyzer input signal. The numbers n and m are in correspondence to the highest orders (n−1) and (m−1) of terms used heretobefore in Equation (1) in the denominator and the numerator polynomials.

Typically, the analyzer input signal is an input speech signal produced in response to utterrance of a certain person. The input cepstrum may be represented by cepstrum components or data of up to about thirtieth order. The number n may be equal to fifteen. The number m may be equal to five or so. The model output signal becomes in this event an output speech signal. By way of example, the time window is the Hamming window known in the art.

Figure 1:
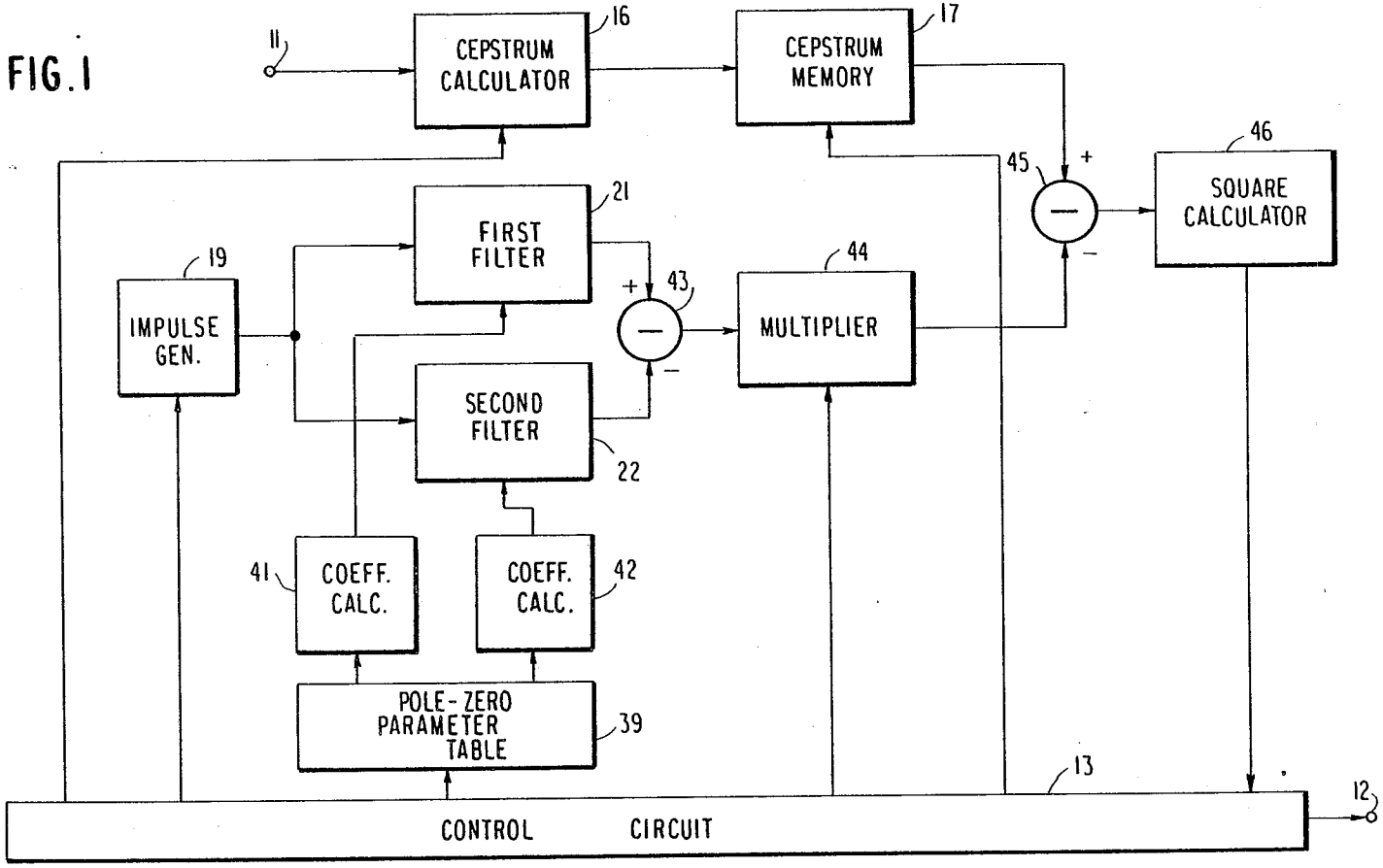
FIG. 1 is a block diagram of a pole-zero analyzer according to a first embodiment of the instant invention.

Referring now to FIG. 1, a pole-zero analyzer according to a first embodiment of this invention is supplied with an input speech signal and is for deciding optimum pole and zero parameters for each time window, in relation to which the input cepstrum is calculated in connection with the input speech signal. The analyzer has analyzer input and output terminals 11 and 12. The analyzer input terminal 11 is supplied with the input speech signal. The analyzer output terminal 12 is for an analyzer output signal representative of the optimum pole and zero parameters. A control circuit 13 is for producing various control signals and carries out certain operations in the manner which will become clear as the description proceeds.

Responsive to a calculation control signal produced by the control circuit 13 as one of the control signals, a cepstrum calculator 16 calculates cepstrum components related to the time window of the input speech signal. In the manner known in the art, such a cepstrum calculator is implemented by a fast Fourier transform (FFT) calculator. Therefore, detailed description is omitted herein as regards the cepstrum calculator 16 and the calculation control signal. The cepstrum components are stored in a cepstrum memory 17 to represent the input cepstrum as a memorized cepstrum.

Responsive to an activation signal produced by the control circuit 13 as another of the control signals, an impulse generator 19 generates a unit impulse. Each of first and second filters 21 and 22 is a parallel circuit which will presently be described and will become clear as the description proceeds. The unit impulse is supplied to the first and the second filters 21 and 22.

Figure 2:
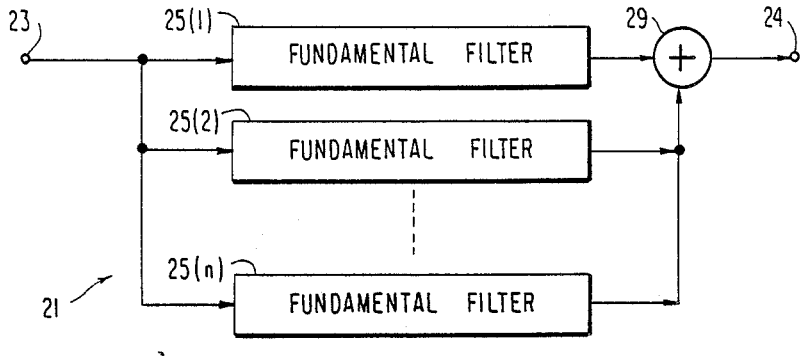
FIG. 2 is a block diagram of a first filter for use in the pole-zero analyzer depicted in FIG. 1.

Turning to FIG. 2 for a short while, each of the first and the second filters 21 and 22 has circuit input and output terminals 23 and 24. The circuit input terminal 23 is supplied with the unit impulse. In each filter 21 or 22, a plurality of fundamental filters are connected in parallel between the circuit input and output terminals 23 and 24. In the first filter 21, the fundamental filters are first through n-th fundamental filters 25(1), 25(2), . . . , and 25(n) and are equal in number to the model pole circuits described before. In the second filter 22, the fundamental filters are first through m-th fundamental filters 25 (suffixes omitted) and are equal in number to the model zero circuits.

Figure 3:
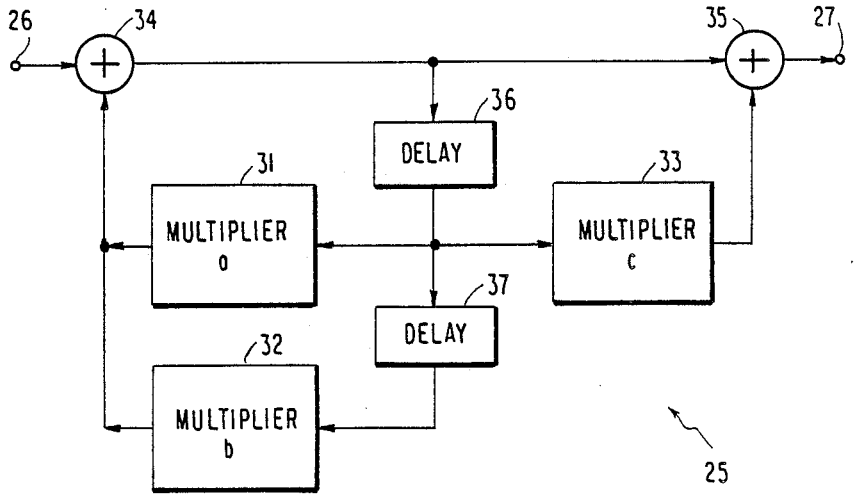
FIG. 3 is a block diagram of a fundamental filter for use in the first filter illustrated in FIG. 2.

Further turning to FIG. 3, each fundamental filter 25 of the first and the second filters 21 and 22 has filter input and output terminals 26 and 27. The filter input terminals of the fundamental filters 25 of each of the first and the second filters 21 and 22 are connected to the circuit input terminal 23 in the manner best shown in FIG. 2. The filter output terminals 27 of the respective fundamental filters 25 are connected to the circuit output terminal 24 through a circuit adder 29 depicted in FIG. 2. Each fundamental filter 25 comprises a second-order pole circuit and a first-order zero circuit.

More particularly, the second-order pole circuit comprises first and second multipliers 31 and 32. The first-order zero circuit comprises a single or third multiplier 33. The first and the second multipliers 31 and 32 are for delivering their outputs to an input-side adder 34. The single multiplier 33 delivers its output to an output-side adder 35. The input-side adder 34 delivers an input-side sum of the unit impulse and the outputs of the first and the second multipliers 31 and 32 to the output-side adder 35 and to a first delay circuit 36. The output-side adder 35 delivers an output-side sum of the input-side sum and the output of the single multiplier 33 to the filter output terminal 27. The first delay circuit 36 delivers a first delayed sum to a second delay circuit 37, the first multiplier 31, and the single multiplier 33. The second delay circuit 37 delivers a second delayed sum to the second multiplier 32.

Turning back to FIG. 1, a pole-zero parameter table 39 is preliminarily loaded with a plurality of candidate pole and zero parameters. Responsive to a selection signal produced by the control circuit 13 as still another of the control signals, the table 39 delivers first through n-th candidate pole parameters to a first coefficient calculator 41 as a pole parameter set and first through m-th candidate zero parameters to a second coefficient calculator 42 as a zero parameter set.

The pole parameter set and the zero parameter set will collectively be called a set pair. It is now understood that the pole-zero parameter table 39 and the selection signal serve collectively as a pole-zero memory arrangement for memorizing a plurality of candidate pole and zero parameters as memorized set pairs. Each memorized set pair consists of a pole parameter set of n candidate pole parameters and a zero parameter set of m candidate zero parameters. The pole-zero memory arrangement produces one of the memorised set pairs at a time as a candidate set pair.

Supplied with each candidate pole parameter of the pole parameter set, the first coefficient calculator 41 calculates first and second pole coefficients and a single zero coefficient. For each candidate zero parameter of the zero parameter set, the second coefficient calculator 42 similarly calculates first and second pole coefficients and a single zero coefficient. In connection with each candidate pole or zero parameter, the first and the second pole coefficients and the single zero coefficient are calculated in accordance with:

$$a=2p\cos\phi,$$

$$b=-p^2,$$

and $$c=-p\cos\phi,$$

respectively, where p and $\phi$ represents the absolute value and the argument of the candidate pole or zero parameter under consideration.

Merely for convenience of the description which follows, the pole and the zero coefficients will be called primary pole and zero coefficients when calculated by the first coefficient calculator 41 in connection with the respective candidate pole parameters of each pole parameter set. The pole and the zero coefficients will be termed secondary pole and zero coefficients when calculated by the second coefficient calculator 42 for each zero parameter set. It should be noted in this connection that each primary or secondary pole coefficient consists of the first and the second pole coefficients calculated as regards one candidate pole or zero parameter.

The first filter 21 is supplied from the first coefficient calculator 41 with the primary pole and zero coefficients and is controlled by such coefficients. The second filter 22 is likewise controlled by the secondary pole and zero coefficients.

More specifically, the first pole coefficient calculated for the first candidate pole parameter of each pole parameter set is used in the first filter 21 as a factor of multiplication in the first multiplier 31 of the first fundamental filter 25(1). The second pole coefficient calculated for the first candidate pole parameter under consideration is used in the second multiplier 32 of the first fundamental filter 25(1). The single zero coefficient calculated for the first candidate pole parameter in question is used in the first filter 21 as a factor of multiplication in the single multiplier 33 of the first fundamental filter 25(1). In this manner, the primary pole and zero coefficients calculated as regards each pole parameter set are used in the fundamental filters 25 of the first filter 21. Similarly, the secondary pole and zero coefficients are used in the fundamental filters 25 of the second filter 22 when calculated by the second coefficient calculator 42 in connection with each zero parameter set belonging to the set pair which includes the pole parameter set used for the primary pole and zero coefficients for simultaneous use in the first filter 21.

It may be mentioned here in connection with the cepstrum calculator 16 that the calculation control signal defines a clock period for use in analyzing the input speech signal. In FIG. 3, the first delay circuit 36 gives a delay of one clock period to the input-side sum on delivering the first delayed sum to the first and the single multipliers 31 and 22 and to the second delay circuit 37. In turn, the second delay circuit 37 gives a delay of one clock period to the first delayed sum on delivering the second delayed sum to the second multiplier 32.

It is now understood that the first filter 21 produces, in response to the unit impulse, a first filter output signal in compliance with a first impulse response which is primarily decided by the primary pole and zero coefficients. In a similar manner, the second filter 22 produces a second filter output signal in accordance with a second impulse response determined primarily by the secondary pole and zero coefficients. A combination of the first filter 21 and the first coefficient calculator 41 serves as a first signal producing arrangement for producing the first filter output signal in response to each pole parameter set supplied from the pole-zero parameter table 39. Another combination of the second filter 22 and the second coefficient calculator 42 serves as a second signal producing arrangement for producing the second filter output signal in response to each zero parameter set belonging to the set pair which includes the pole parameter set simultaneously produced by the table 39. The impulse generator 19 is shared by the first and the second signal producing arrangements.

In FIG. 1, a filter output subtracter 43 is for subtracting the second filter output signal from the first filter output signal to produce a filter output difference signal representative of a filter output difference between the first and the second filter output signals. The filter output difference signal has a waveform decided by the first and the second impulse responses and can be defined by first through n-th terms. A filter output multiplier 44 is for calculating products of first through n-th coefficients and the first through the n-th terms of the difference signal, respectively. The first through the n-th coefficients are given by inverse numbers of time intervals corresponding to the first through the n-th terms of the difference signal. The multiplier 44 thereby produces a product signal representative of the products which are calculated as regards each candidate set pair of the pole and the zero parameter sets. The product signal is therefore equivalent to a model output cepstrum of a model output signal which is produced by a pole-zero model defined by the candidate set pair being dealt with.

As a consequence, a combination of the filter output subtracter 43 and the filter output multiplier 44 serves as a converting arrangement for converting the first and the second filter output signals to the converted signal which is equivalent to the model output cepstrum defined by each candidate set pair. The converting arrangement may alternatively be called an analysis filter, which analyzes the first and the second filter output signals into the converted signal. The multiplier 44 may be supplied with an activation signal produced by the control circuit 13 as yet another of the control signals. If necessary, this activation signal should include coefficient signals representative of the first through the n-th coefficients.

The cepstrum memory 17 is now supplied with a memory read signal produced by the control circuit 13 as one of the control signals. In response, the memorized cepstrum is delivered to a cepstrum subtracter 45. Concurrently, the converted signal is delivered from the filter output multiplier 44 to the cepstrum subtracter 45. As a result, the cepstrum subtracter 45 subtracts the converted signal from the memorized cepstrum to produce a cepstrum difference signal representative of a cepstrum difference between the memorized cepstrum and the converted signal.

In the meanwhile, the control circuit 13 repeatedly produces the selection signal to make the pole-zero parameter table 39 successively produce L candidate set pairs, where L represents a first predetermined natural number. Responsive to the L respective candidate set pairs, the converting arrangement successively produces L converted signals. The cepstrum subtracter 45 subtracts the L converted signals from the memorized cepstrum to make the cepstrum difference signal successively represent L cepstrum differences.

Supplied with the cepstrum difference signal from the cepstrum subtracter 45, a square calculator 46 calculates L squares of the respective cepstrum differences to produce a square signal representative of the respective squares. The square signal is delivered to the control circuit 13. In the manner known in the art, the control circuit 13 finds a particular set pair among the L candidate set pairs that minimizes the squares.

In the manner described in the Fushikida paper referred to hereinabove, the control circuit 13 carries out focussing of the candidate set pairs in first through M-th stages, where M has no relation to the number m of the zero circuits but represents a second predetermined natural number. On describing the focussing a little more in detail, it will be presumed that L candidate set pairs are used in each of the M stages.

For use in the first stage, the control circuit 13 produces a first selection signal. In response, the pole-zero parameter table 39 produces a first group of L candidate set pairs which are widely spaced among the memorized set pairs. Supplied with the square signal produced in the first stage, the control circuit 13 finds the particular set pair among the first group as a rough approximation of the selected set pair and produces, for use in the second stage, a second selection signal with reference to the rough approximation. The second selection signal makes the table 39 produce a second group of L candidate set pairs which are less widely spaced among the memorized set pairs than the L candidate set pairs of the first group. In this manner, the L candidate set pairs of the first group are focussed in the M-th stage to a close appoximation of the selected set pair.

The control circuit 13 supplies the analyzer output terminal 12 with the analyzer output signal made to represent the close approximation as the selected set pair. In the manner taught in the Fushikida paper, each of the first and the second predetermined natural numbers L and M may be equal to four. Alternatively, the first predetermined natural number L may be equal to two and the second predetermined natural number M, equal to eight.

It will now be appreciated that the control circuit 13 and the selection signal collectively serve as a focussing arrangement responsive to the square signal for focussing the L candidate set pairs to the selected set pair. A combination of the square calculator 46 and the focussing arrangement serves as a selecting arrangement responsive to the cepstrum difference signal for selecting one of the memorized set pairs as the selected set pair.

Figure 4:
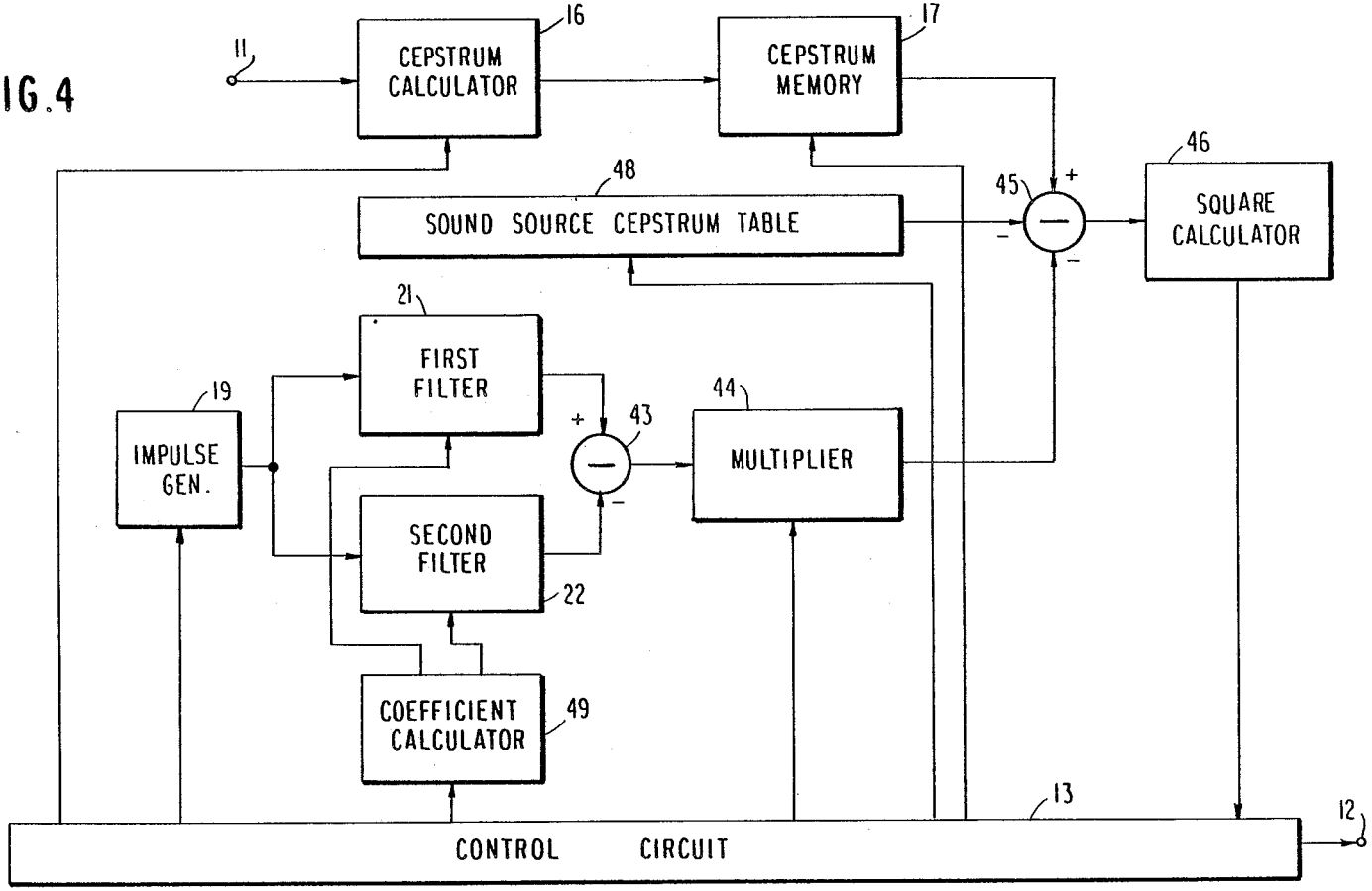
FIG. 4 is a block diagram of a pole-zero analyzer according to a second embodiment of this invention.

Referring to FIG. 4, a pole-zero analyzer according to a second embodiment of this invention comprises similar parts which are designated by like reference numerals and are operable with likewise named signals. In addition to the similar parts, a sound source cepstrum table 48 is used in memorizing sound source cepstra of source output signals which are actually produced from sound sources and are preliminarily analysed into the sound source cepstra in the manner described in conjunction with the input speech signal. Responsive to a table read signal produced by the control circuit 13 as one of the control signals, the sound source cepstrum table 48 successively delivers the sound source cepstra to the cepstrum subtracter 45 as read-out cepstra. The sound sources may be four or five different articulations of the speech organ when the pole-zero analyzer is used in analyzing utterance of a single person.

In FIG. 4, a coefficient calculator 49 represents a combination of the pole-zero parameter table 39 and the first and the second coefficient calculators 41 and 42 described in connection with FIG. 1. The cepstrum subtracter 45 subtracts the read-out cepstra successively from the memorized cepstrum to make the cepstrum difference signal successively represent additional differences between the memorized cepstrum and the respective read-out cepstra. Responsive to the square signal produced by the square calculator 46 for the additional differences, the control circuit 13 selects one of the sound source cepstra that is most similar to the memorized cepstrum. The control circuit 13 thereby makes the analyzer output signal further represent the selected one of the sound source cepstra.

It is now understood that the control circuit 13 and the table read signal collectively serve as the selecting arrangement of the type described before in conjunction with FIG. 1. It should be noted that the sound source cepstra need not be subjected to focussing. The table read signal may therefore be produced either before or after the L candidate set pairs are focussed to the selected set pair.

Figure 5:
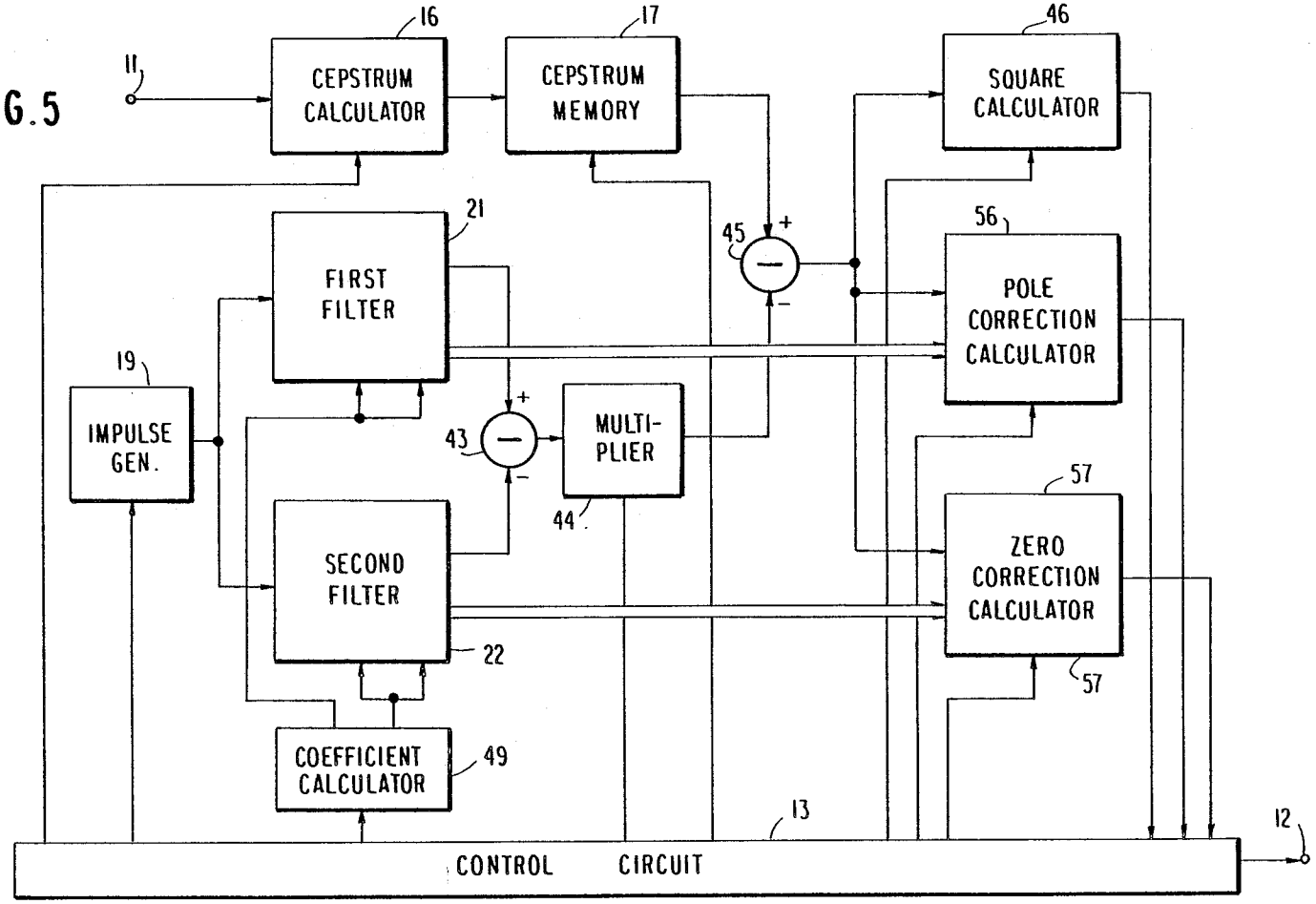
FIG. 5 is a block diagram of a pole-zero analyzer according to a third embodiment of this invention.

Referring now to FIG. 5, a pole-zero analyzer according to a third embodiment of this invention includes similar parts which are again designated by like reference numerals. It should be noted that the analyzer does not carry out the focussing. Although designated by the reference numerals 21 and 22, the first and the second filters are different to a certain extent from those described in conjunction with FIGS. 1 through 3 in the manner which will become clear as the description proceeds. Moreover, the coefficient calculator 49 comprises additional calculators which will presently be described.

Figure 6:
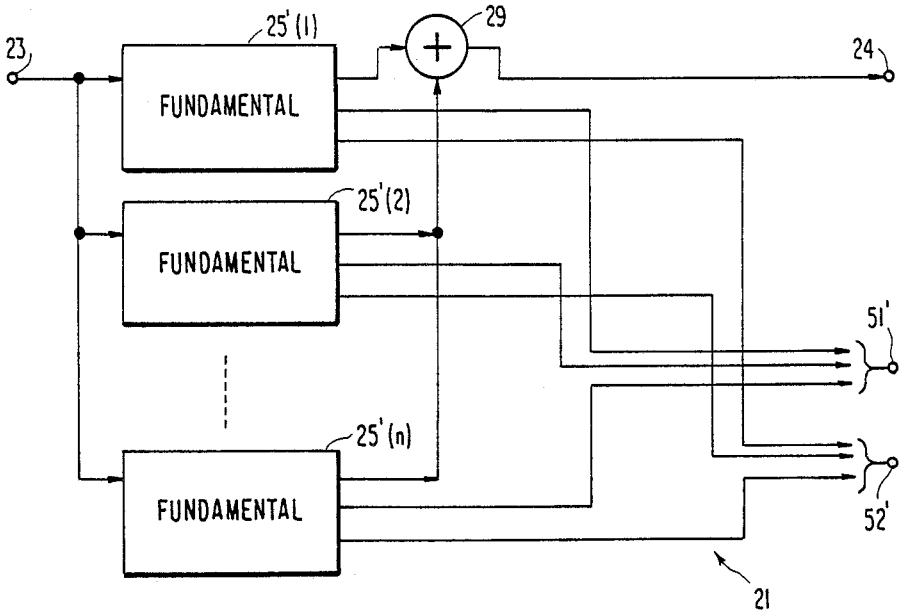
FIG. 6 is a block diagram of a first filter for use in the pole-zero analyzer shown in FIG. 5.
Figure 7:
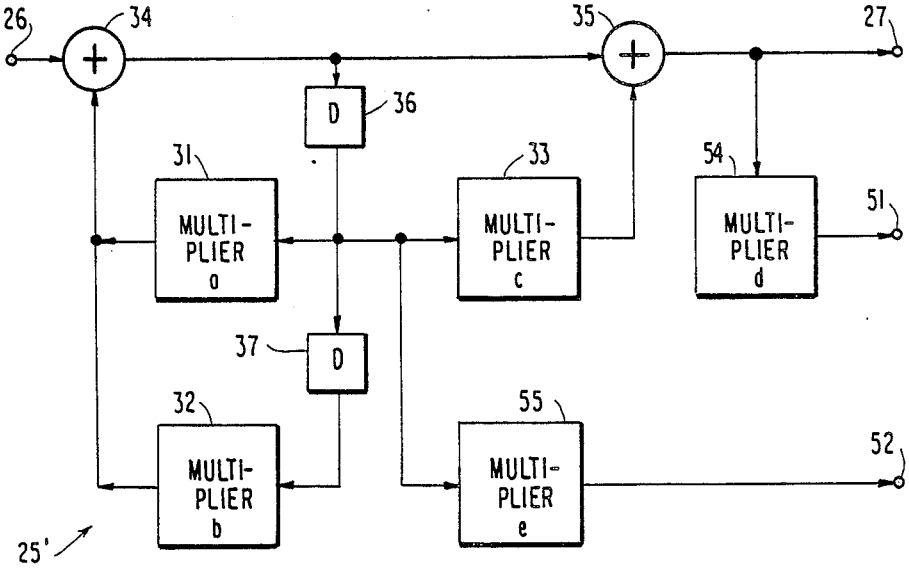
FIG. 7 is a block diagram of a fundamental filter for use in the first filter illustrated in FIG. 6.

Turning temporarily to FIGS. 6 and 7, the first filter 21 has a circuit input terminal 23 and a primary output terminal 24 and comprises first through n-th fundamental filters which are now indicated at 25'(1), 25'(2), . . . , and 25'(n). Each of the fundamental filters 25' (suffixes omitted) has a filter input terminal 26 and a primary filter output terminal 27. Like in FIG. 2, the primary filter output terminals 27 of the respective fundamental filters 25' are connected to the primary output terminal 24 through a circuit adder 29. Each fundamental filter 25' includes first and second multipliers 31 and 32, a single or third multiplier 33, input-side and output-side adders 34 and 35, and first and second delay circuits 36 and 37. In structure, the second filter 22 differs from the first filter 21 only as regards the number of fundamental filters and comprises first through m-th fundamental filters 25'. The first and the second filters 21 and 22 are operable with likewise named signals insofar as concerned with the parts thus far described.

In FIGS. 6 and 7, each fundamental filter 25' of the first and the second filters 21 and 22 has first and second secondary filter output terminals 51 and 52. The first secondary filter output terminals 51 of the respective fundamental filters 25' are collectively indicated at 51' as a first secondary output terminal of each of the first and the second filters 21 and 22. The second secondary filter output terminals 52 of the respective fundamental filters 25' are similarly indicated at 52' as a second secondary output terminal of the filter 21 or 22.

In FIG. 7, each fundamental filter 25' comprises a fourth multiplier which will be referred to as an amplitude multiplier 54 for the reason which will shortly become clear. Incidentally, the word "amplitude" is used herein to mean the absolute value. The amplitude multiplier 54 is supplied with the output-side sum from the output-side adder 35 to deliver an amplitude coefficient signal to the first secondary filter output terminal 51. An argument or fifth multiplier 55 is supplied with the first delayed sum from the first delay circuit 36 to deliver an argument coefficient signal to the second secondary filter output terminal 52.

When the fundamental filter 25' is included in the first filter 21, the amplitude and the argument coefficient signals will be called pole amplitude and argument coefficient signals. When related to the second filter 22, the amplitude and the argument coefficient signals will be termed zero amplitude and argument coefficient signals.

Referring back to FIG. 5, the coefficient calculator 49 comprises, as first and second primary coefficient calculators, the first and the second coefficient calculators 41 and 42 described in connection with FIG. 1. The first and the second primary coefficient calculators are operable in the manner described before to make the first and the second filters 21 and 22 produce the first and the second filter output signals. Additionally, the coefficient calculator 49 comprises first and second secondary coefficient calculators. It should be understood that the first secondary coefficient calculator is illustrated by a combination of the coefficient calculator 49 and one of two signal lines depicted below the first filter 21. The second secondary coefficient calculator is illustrated by another combination of the coefficient calculator 49 and one of two signal lines drawn to the second filter 22.

Supplied with each candidate pole parameter of the pole parameter set of each candidate set pair from the pole-zero parameter table included in the coefficient calculator 49, the first secondary coefficient calculator calculates a pole amplitude coefficient and a pole argument coefficient. For each candidate zero parameter of the candidate set pair under consideration, the second secondary coefficient calculator calculates a zero amplitude coefficient and a zero argument coefficient. The pole or the zero amplitude and argument coefficients are calculated according to:

$$d=-1/p,$$

and $$e=-2p\sin\phi,$$

respectively.

First through n-th pole amplitude coefficients are calculated by the first secondary coefficient calculator as regards the first through the n-th candidate pole parameters and are used in the first filter 21 as factors of multiplication in the amplitude multipliers 54 of the first through the n-th fundamental filters 25'. First through n-th pole argument coefficients are similarly calculated and are used in the argument mutipliers 55 of the first through the n-th fundamental filters 25'. The first filter 21 produces, in addition to the first filter output signal, first through n-th pole amplitude and argument signals in the manner indicated by a double signal line.

First through m-th zero amplitude coefficients are calculated by the second secondary coefficient calculator in connection with the first through the m-th candidate zero parameters and are used in the second filter 22 as factors of multiplication in the amplitude multipliers 54 of the first through the m-th fundamental filters 25'. First through m-th zero argument coefficients are likewise calculated and are used in the argument multipliers 55 of the first through the m-th fundamental filters 25'. The second filter 22 produces, besides the second filter output signal, first through m-th zero amplitude and argument signals as indicated by another double signal line.

In FIG. 5, the difference signal is supplied from the cepstrum subtracter 45 to the square calculator 46. Supplied with an identification signal produced by the control circuit 13 as a further one of the control signals substantially concurrently with the memory read signal, the square calculator 46 calculates a square of the cepstrum difference as a square error, namely, as a square of an error which the converted signal has relative to the memorized cepstrum. The square calculator 46 thereby delivers an error signal representative of the square error to the control circuit 13. It should be understood that the control circuit 13 includes a memory which is depicted by two signal lines for the identification and the error signals and which is for memorizing the identification and the error signals. The identification signal identifies at first a first candidate set pair selected by the selection signal and then other candidate set pairs in the manner which will shortly become clear.

With attention directed to Equation (1) referenced heretobefore, each of the numbers 1 through n, both inclusive, will be denoted by i and each of the numbers 1 through m, by k. It will readily be understood that the square error is a function of variables which are the absolute values and the argements of the candidate pole and zero parameters of each candidate set pair.

The i-th pole amplitude signal represents a value which is equivalent to a partial derivative the square error has relative to the absolute value of the i-th candidate pole parameter. The i-th pole argument signal reperests another value which is equivalent to a partial derivative of the square error with respect to the argument of the i-th candidate pole parameter. The k-th zero amplitude signal represents still another value which is equivalent to a partial derivative of the square error in relation to the absolute value of the k-th candidate zero parameter. The k-th zero argument signal represents yet another value which is equivalent to a partial derivative of the square error in connection with the argument of the k-th candidate zero parameter.

Supplied with the difference signal from the cepstrum subtracter 45, with the pole amplitude and argument signals from the first filter 21, and with a first control signal produced by the control circuit 13 as a still further one of the control signals, a pole correction calculator 56 calculates corrections which should be effected to the candidate pole parameters of the pole parameter set in the candidate set pair being dealt with. The pole correction calculator 56 thereby supplies the control circuit 13 with a pole correction signal representative of the corrections for the pole parameters.

Similarly supplied with the difference signal from the cepstrum subtracter 45, with the zero amplitude and argument signals from the second filter 22, and with a second control signal produced substantially simultaneously with the first control signal by the control circuit 13 as a yet further one of the control signals, a zero correction calculator 57 calculates corrections which should be effected on the candidate zero parameters of the zero parameter set of the candidate set pair in question. The zero correction calculator 57 thereby produces a zero correction signal representative of the corrections for the zero parameters.

With reference to the identification signal and the pole and the zero correction signals, the control circuit 13 decides another candidate set pair which results in another converted signal more similar to the memorized cepstrum. In this manner, the memory of the control circuit 13 is eventually loaded with a few square errors in response to the error signals produced for the candidate set pairs. In the known manner, the control circuit 13 confirms a minimum of the square errors to make the analyzer output signal represent the optimum pole and zero parameters.

It is now understood that the impulse generator 19 and the control circuit 13 are shared by a pole and a zero correcting arrangement. The pole correcting arrangement additionally comprises the amplitude and the argument multipliers 54 and 55 of the first filter 21 and the pole correction calculator 56 and is responsive to the difference signal, the pole amplitude and argument coefficients, and the error signal to correct the candidate pole parameters of each candidate set pair towards the optimum pole parameters. Similarly, the zero correcting arrangement additionally comprises the amplitude and the argument multipliers 54 and 55 of the second filter 22 and the zero correction calculator 57 to be responsive to the difference signal, the zero amplitude and argument coefficients, and the error signal in correcting the candidate zero parameters of the candidate set pair under consideration towards the optimum zero parameters.

It will now be appreciated that the afore-described selecting arrangement comprises the first and the second secondary coefficient calculators, the square calculator 46, and the pole and the zero correcting arrangements. Responsive to the difference signal, the selecting arrangement selects one of the memorized set pairs as the selected set pair.

Reviewing FIGS. 1 through 7, it will now be easy for one skilled in the art to practically implement various parts. For example, the pole-zero parameter table 39 can be designed in detail by one skilled in the art of pole-zero models. The control circuit 13 will readily be designed with reference to the description so far made. Although somewhat differently described, the square signal is not different from the square error signal. In any event, the square signal is in practice a square-sum signal representative of a total sum of squares differences or errors between corresponding components of the memorized cepstrum and the converted signal.

While this invention has thus far described in specific conjunction with a few preferred embodiments thereof, it will now be readily possible for one skilled in the art to carry this invention into effect in various other manners. For instance, the frequency axis can be converted to the Melscale known in the art in order to reduce the number of pole and the zero circuits. The pole-zero model may comprise only one zero circuit. The cepstrum components can be treated with a weight on lower-order components in order to more clearly define the optimum pole and zero parameters. The analyzer input signal need not be a speech signal but can be one of various other signals that can be analyzed into a cepstrum.

What is claimed is:

1. A pole-zero analyzer responsive to an input cepstrum related to each time window of an input signal for deciding optimum pole parameters, n in number, and optimum zero parameters, m in number, where each of n and m represents a predetermined integer, said analyzer comprising:

pole-zero memory means for memorizing a plurality of candidate pole and zero parameters in memorized set pairs, each memorized set pair consisting of a pole parameter set of n candidate pole parameters and a zero parameter set of m candidate zero parameters, said pole-zero memory means producing one of said memorized set pairs at a time as a candidate set pair;

first signal producing means responsive to the pole parameter set of said candidate set pair for producing a first output signal;

second signal producing means responsive to the zero parameter set of said candidate set pair for producing a second output signal;

converting means for converting said first and said second output signals to a converted signal which is equivalent to a model output cepstrum of a model output signal produced by a pole-zero model defined by said candidate set pair;

a subtracter for calculating a difference between said input cepstrum and said converted signal to produce a difference signal representative of said difference; and selecting means responsive to said difference signal for selecting one of said memorized set pairs as a selected set pair consisting of said optimum pole parameters and said optimum zero parameters.

2. A pole-zero analyzer as claimed in claim 1, wherein:

said first and said second signal producing means comprise an impulse generator in common, said impulse generator being for generating a unit impulse;

said first signal producing means comprising:

first calculating means responsive to the pole parameters set of said candidate set pair for calculating primary pole and zero coefficients; and a first filter controlled by said primary pole and zero coefficients to produce said first output signal in response to said unit impulse;

said second signal producing means comprising:

second calculating means responsive to the zero parameter set of said candidate set pair for calculating secondary pole and zero coefficients; and a second filter controlled by said secondary pole and zero coefficients to produce said output signal in response to said unit impulse.

3. A pole-zero analyzer as claimed in claim 2, wherein:

said pole-zero memory means is for successively producing the candidate set pairs, L in number, where L represents a predetermined natural number;

said subtracter making said difference signal represent the differences, L in number, as cepstrum differences when said L candidate set pairs are produced;

said selecting means comprising:

square calculating means responsive to said difference signal for calculating squares of the respective cepstrum differences to produce a square signal representative of said squares; and focussing means responsive to said square signal for focussing said L candidate set pairs to said selected set pair.

4. A pole-zero analyzer as claimed in claim 1, further comprising sound source cepstrum table means for memorizing a plurality of sound source cepstra to successively produce said sound source cepstra as read-out cepstra;

said subtracter being responsive to said input cepstrum and said read-out cepstra to make said difference signal successively represent additional differences between said input cepstrum and the respective read-out cepstra;

said selecting means being for furthermore selecting one of said sound source sepstra as a selected cepstrum which is most similar to said input cepstrum.

5. A pole-zero analyzer as claimed in claim 1, wherein:

said first and said second signal producing means comprise an impulse generator in common, said impulse generator being for generating a unit impulse;

said first signal producing means comprising:

first primary calculating means responsive to the pole parameter set of said candidate set pair for calculating primary pole and zero coefficients; and a first filter controlled by said primary pole and zero coefficients to produce said first output signal in response to said unit impulse;

said second signal producing means comprising:

second primary calculating means responsive to the zero parameter set of said candidate set pair for calculating secondary pole and zero coefficients; and a second filter controlled by said secondary pole and zero coefficients to produce said second output signal in response to said unit impulse.

6. A pole-zero analyzer as claimed in claim 5, wherein said selecting means comprises:

first secondary calculating means responsive to the pole parameter set of said candidate set pair for calculating pole amplitude and argument coefficients;

second secondary calculating means responsive to the zero parameter set of said candidate set pair for calculating zero amplitude and argument coefficients;

square calculating means responsive to said difference signal for calculating a square of said difference to produce a square signal representative of said square;

pole correcting means responsive to said difference signal, said pole amplitude and argument coefficients, and said square signal for correcting the candidate pole parameters of said candidate set pair towards said optimum pole parameters; and zero correcting means responsive to said difference signal, said zero amplitude and argument coefficients, and said square signal for correcting the candidate zero parameters of said candidate set pair towards said optimum zero parameters.

* * * * *